US006733247B2

(12) United States Patent
Dwyer et al.

(10) Patent No.: US 6,733,247 B2
(45) Date of Patent: May 11, 2004

(54) PUMPING DEVICE FOR VISCOUS SLURRY MATERIAL

(75) Inventors: Bernard B. Dwyer, Cincinnati, OH (US); Kenneth T. Eddy, Cincinnati, OH (US)

(73) Assignee: Magnum Pumps, Inc., West Chester, OH (US)

( * ) Notice: Subject to any disclaimer, the term of this patent is extended or adjusted under 35 U.S.C. 154(b) by 122 days.

(21) Appl. No.: 10/111,308

(22) PCT Filed: Dec. 28, 2001

(86) PCT No.: PCT/US01/49589

§ 371 (c)(1),
(2), (4) Date: Apr. 23, 2002

(87) PCT Pub. No.: WO03/062639

PCT Pub. Date: Jul. 31, 2003

(65) Prior Publication Data

US 2003/0123996 A1 Jul. 3, 2003

(51) Int. Cl.[7] ..... F04B 53/00; F04B 15/02
(52) U.S. Cl. ..... 417/234; 417/360; 417/900
(58) Field of Search ..... 417/234, 360, 417/364, 900

(56) References Cited

U.S. PATENT DOCUMENTS

| | | | | |
|---|---|---|---|---|
| 2,747,510 A | * | 5/1956 | Von Seggern | 417/360 |
| 3,298,322 A | * | 1/1967 | Sherrod | 417/900 |
| 3,398,693 A | * | 8/1968 | Schumann | 417/900 |
| 3,421,744 A | * | 1/1969 | O'Connell | 366/45 |
| 3,465,685 A | * | 9/1969 | Sherrod | 417/900 |
| 4,019,839 A | * | 4/1977 | Schwing | 417/900 |
| 4,097,962 A | | 7/1978 | Alley et al. | |
| 4,533,300 A | * | 8/1985 | Westerlund et al. | 417/900 |
| 4,869,655 A | | 9/1989 | Powers et al. | |
| 5,334,001 A | | 8/1994 | Williams | |
| 6,116,865 A | | 9/2000 | Fischer et al. | |
| 6,227,813 B1 | | 5/2001 | Leimer | |
| 6,267,571 B1 | * | 7/2001 | Anderson et al. | 417/900 |

OTHER PUBLICATIONS

International Search Report (4 pages).
Big Blue PTV 700 (Brochure, 6 pages) (Putzmeister America) (MM 5161–6 US).
Raise–Rite/HMI Hydraulic Mudpumps HM–Power Pump–2 (Printed from website www.raise–rite.com/machine/hm-power_2.html on Apr. 23, 2002) (two pages).
Raise–Rite/HMI Hydraulic Mudpumps HM–Power Pump–1 (Printed from website www.raise–rite.com/machine/hm-power_1.html on Apr. 23, 2002) (two pages).
Raise–Rite/HMI Hydraulic Mudpumps HM–1 (Printed from website www.raise–rite.com/machine/hm_1.html on Apr. 23, 2002) (one page).
Raise–Rite/HMI Hydraulic Mudpumps HM–VersaPumps (printed from website www.raise–rite.com/machine.hm_pea.html on Apr. 23, 2002) (two pages).

(List continued on next page.)

*Primary Examiner*—Cheryl J. Tyler
(74) *Attorney, Agent, or Firm*—Wood, Herron & Evans, LLP

(57) ABSTRACT

A device for pumping a viscous slurry material. In one aspect, the pumping device is dimensioned to be insertable into the space between the side jambs of a standard building doorway. The pumping device is self-propelled and a mixer is removably attachable to the device for movement therewith. The pumping device includes a containment hopper and a swing tube pump having a swing tube with a wiper blade that agitates the viscous slurry material in the containment hopper. The pumping device has a frame assembled from multiple laser cut components. The pumping device is provided with a precision-machined manifold having a plurality of internal passageways directing a flow of hydraulic fluid to various pump components. A removable panel covers an aperture in a side wall of the containment hopper and is removable to provide access to the interior of the hopper for cleaning.

38 Claims, 9 Drawing Sheets

OTHER PUBLICATIONS

Schwing America, Inc. Concrete Pumps Line Pumps P–88 (printed from website wwww.schwing.com/O1__cpumps/linepumps/88/index.html on Apr. 23, 2002) (one page).

Schwing America, Inc. Concrete Pumps Line Pumps HBV–160 (printed from website www.schwing.com/O1__cpumps/linepumps/160/index.html on Apr. 23, 2002) (one page).

Schwing America, Inc. Concrete Pumps Line Pumps WP 301X (printed from website www.schwing.com/O1__cpumps/linepumps/301/index.html on Apr. 23, 2002) (one page).

Schwing America, Inc. Concrete Pumps Line Pumps WP 305X (printed from website www.schwing.com/O1__cpumps/linepumps/305/index.html on Apr. 23, 2002) (one page).

Schwing America, Inc. Concrete Pumps Line Pumps BPA 450 (printed from website www.schwing.com/O1__cpumps/linepumps/450/index.html on Apr. 23, 2002) (one page).

Schwing America, Inc. Concrete Pumps Line Pumps WP 750–15X (printed from website www.schwing.com/O1__cpumps/linepumps/15x/index.html on Apr. 23, 2002) (one page).

Schwing America, Inc. Concrete Pumps Line Pumps WP 750–18X (printed from website www.schwing.com/O1__cpumps/linepumps/18x/index.html on Apr. 23, 2002) (one page).

Schwing America, Inc. Concrete Pumps Line Pumps WP 1000X (printed from website www.schwing.com/O1__cpumps/linepumps/1000/index.html on Apr. 23, 2002) (one page).

Schwing America, Inc. Concrete Pumps Line Pumps WP 1250X (printed from website www.schwing.com/O1__cpumps/linepumps/1250/index.html on Apr. 23, 2002) (one page).

Schwing America, Inc. Concrete Pumps Line Pumps BPA 4000 (printed from website www.schwing.com/O1__cpumps/linepumps/4000/index.html on Apr. 23, 2002) (one page).

Schwing America, Inc. Concrete Pumps Line Pumps BPA 8000 (printed from website www.schwing.com/O1__cpumps/linepumps/8000/index.html on Apr. 23, 2002) (one page).

* cited by examiner

10

PUMPING DEVICE FOR VISCOUS SLURRY MATERIAL

FIELD OF THE INVENTION

This invention relates to a pumping device and, in particular, to a portable device operative to pump viscous slurry materials and that is readily positionable in enclosed spaces and restricted-access application sites.

BACKGROUND OF THE INVENTION

Various pumping devices are commonly used in the application, laying, pouring, spraying or placement of viscous slurry materials, such as concrete, plaster, mortar, shotcrete, grout, gunite, refractories and the like. The pumping device is operative for moving the viscous slurry material from a transport truck mixer or other source to the application site. Pumping devices for such viscous slurry materials have been traditionally rendered mobile for transport to and use at the application site by integration with a conventional vehicle or by mounting on a trailer for towing by a conventional vehicle. However, conventional pumping devices are impractical for placing viscous slurry materials in enclosed spaces, remote locations beyond the throw of conventional pumps, or application sites with restricted physical access.

Most pumping devices include a hopper that receives successive supplies of viscous slurry material from the mixer and that holds the viscous slurry material for pumping from the hopper to a supply line that ends at the placement location of the application site. Typically, pumping operations require a mixer operative for providing multiple supplies of the viscous slurry material to the hopper of the pumping device. The mixer must likewise be transported to the job site and positioned in a location proximate to the pumping device.

One common type of pump is an swing tube pump having a pair of movable pistons and an S-shaped swing tube with an inlet immersed in the viscous slurry material and a discharge outlet rotatably attached to a discharge port of the hopper. The swing tube is adapted for unidirectional flow of cement under pressure from the discharge outlet in response to the movement of the rams of the pistons. However, swing tube pumps suffers from a significant deficiency in that the S-shape of the swing tube creates a stagnant volume of viscous slurry material near the bottom, usually s-curved, of the hopper. The viscous slurry material in this stagnant volume is not periodically pumped from the hopper. As a result, the viscous slurry material in the stagnant volume thickens, which hinders the operation of the pumping device and reduces the pumping efficiency.

After the pumping device is used, the hopper and other portions of the pumping device exposed to the viscous slurry material are contaminated with residues. The hopper is thoroughly cleaned with a stream of water that dissolves the residues and suspends particles therein. However, the hoppers of conventional pumping devices lack a convenient means for effectively draining the soiled water from the interior of the hopper. Typically, it is inconvenient or impossible to simply tilt the hopper to permit the soiled water to drain from the inlet opening into which the viscous slurry material is provided from the mixer. Drain ports are typically provided on a bottom surface of the hopper. However, the positions of such ports are not readily accessible for manual removal. As a result, draining the soiled water from the hopper is a non-trivial task.

Conventional pumping devices include a pump that is hydraulically powered and a hydraulic system that routes the hydraulic fluid for controlling the operation of the pump. Such hydraulic control systems rely on multiple hydraulic lines or hoses that interconnect the various components constituting the system. These conventional hydraulic systems have significant disadvantages, including their relatively large size and the relatively large number of hoses required to provide the system interconnections. In addition, large numbers of hoses are difficult to maintain and introduce numerous locations in the hydraulic system at which leaks may develop.

Accordingly, there is a need for an improved pumping device for viscous slurry materials that can be positioned in enclosed spaces and restricted-access application sites. Furthermore, there is a need for an improved pumping device for viscous slurry materials that facilitates cleaning of the hopper, that provides thorough mixing in all portions of the hopper, that reduces the complexity and size of the hydraulic system, and/or that better cooperates with mixers.

SUMMARY OF THE INVENTION

The invention provides a pumping device for viscous slurry materials that, in one aspect, can be positioned in enclosed spaces and restricted-access areas. The pumping device of the present invention achieves this objective by defining a footprint between opposite lateral sides spaced apart by a width of the apparatus so dimensioned as to be insertable into the space between the side jambs of a standard walkthrough man-door. The pumping device has various components, including a hopper having an upper opening adapted to receive the viscous slurry material and an outlet below the upper opening adapted to eject the viscous slurry material, a swing tube pump adapted to pump the viscous slurry material from the hopper to be ejected out of the hopper outlet, and rolling support members movably supporting the frame. The swing tube pump includes a swing tube in the hopper and a piston pump operatively associated with the swing tube. According to principles of the invention, the components of the pumping device are substantially entirely between at least the opposite lateral sides of the footprint.

By virtue of the foregoing, there is provided an improved pumping device for viscous slurry materials that is self-contained and that is readily movable on the rolling support members including movement, for example, through the space between the side jambs of the standard walkthrough man-door. As a result, the pumping device may be readily positioned into and out of enclosed spaces and restricted-access application sites and, in certain embodiments, the pumping device may provide the motive power to move a releasably attachable mixer into such spaces and sites.

In another embodiment, the invention provides a pumping device for viscous slurry materials that thoroughly mixes the viscous slurry material in all portions of the hopper. The pumping device of the present invention achieves this objective by providing a swing tube with a wiper blade that conforms to the curvature of a concave surface below the swing tube inside the hopper. The pumping device includes the hopper having an upper opening adapted to receive the viscous slurry material and an outlet below the upper opening adapted to eject the viscous slurry material, and the bottom wall below the opening and outlet defining the concave surface in the hopper, and a swing tube pump adapted to pump the viscous slurry material from the hopper to be ejected out of the hopper outlet. The swing tube pump includes the swing tube adapted to move relative to the concave surface and a piston pump operatively associated with the swing tube.

By virtue of the foregoing, there is provided a pumping apparatus that is capable of agitating the viscous slurry material located in the space between the swing tube and the concave surface of the hopper. This provides thorough mixing of the entire volume of viscous slurry material while contained in the hopper and awaiting pumping.

In yet another embodiment, the invention provides a pumping device for viscous slurry materials that has a simpler and physically smaller hydraulic system. The pumping device of the present invention achieves this objective by providing a control unit for the pumping device with a block manifold having numerous internal passageways and various valves controlling the flow of hydraulic fluid to a pump. The control unit is supported on a frame of the pumping device and is operatively coupled to a power unit and the pump. Also supported on the frame is the power unit operatively coupled to the swing tube. The power unit includes a hydraulic pump capable of pumping hydraulic fluid and a power supply operatively coupled with the hydraulic pump.

By virtue of the foregoing, the pumping device for viscous slurry materials is provided with a simpler and physically compact hydraulic system due to the introduction of a manifold that is compact and that requires fewer hoses to establish the requisite external hydraulic connections.

In yet another embodiment, the invention provides a pumping device for viscous slurry materials that cooperates with multiple types of mixers. The pumping device of the present invention achieves this objective by providing a mixer movably supported on rollers so as to be movable towards and away from the frame of the pump. The mixer further includes one or more engagement elements normally at the elevation of any one or more complementary engagement elements of the frame so as to be engageable therewith by moving the pump and mixer together laterally and without providing temporary stilts for, or lifting, the mixer. The pumping device further includes a hopper supported by the frame adjacent to the frame-side engagement elements and having an upper opening adapted to receive the viscous slurry material and an outlet below the upper opening adapted to eject the viscous slurry material, and a pump adapted to pump the viscous slurry material from the hopper to be ejected out of the outlet.

By virtue of the foregoing, the mixer is positionable, when attached to the frame, for providing successive supplies of the viscous slurry material to the hopper through its upper opening. Also when engaged, the mixer is movable on its rollers with the pump so as to be transported about the work site with the assistance of motive power provided from a self-propelled pumping device. The ability to select among various mixers provides versatility and flexibility in matching a particular mixer to the pumping device.

These and other objects and advantages of the present invention shall be made apparent from the accompanying drawings and description thereof.

BRIEF DESCRIPTION OF THE DRAWINGS

The accompanying drawings, which are incorporated in and constitute a part of this specification, illustrates an embodiment of the invention and, together with a general description of the invention given above, and the detailed description of the embodiment given below, serve to explain the principles of the invention.

DETAILED DESCRIPTION

The present invention is a pumping device operative for pumping viscous slurry materials, including concrete, plaster, mortar, shotcrete, grout, gunite, refractories and the like, that typically consist of an aggregate or particles, such as grains of sand or gravel, suspended in a viscous base liquid. The pumping device of the present invention has a compact size without a concomitant sacrifice of pumping capacity when compared with conventional pumping devices.

Figure 1:
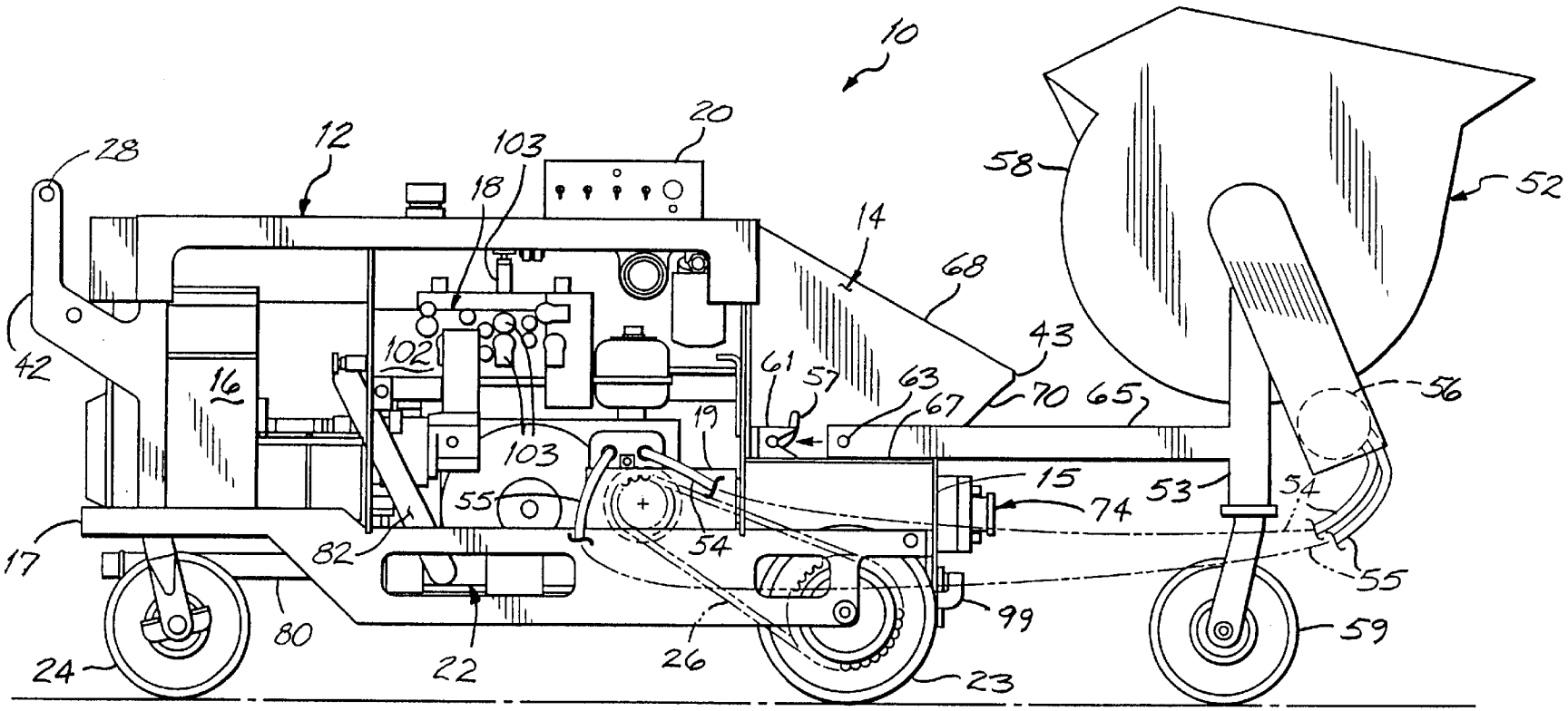
FIG. 1 is a side elevational view of a pumping device embodying principles of the present invention.

With reference to FIG. 1, a pumping device 10 operative to pump viscous slurry material 11 (FIG. 7) includes a frame 12, a containment hopper 14 supported at one longitudinal end 15 of the frame 12, a power unit 16 supported at an opposite longitudinal end 17 of the frame 12, a hydraulic control system 18 mounted centrally to the frame 12, a control unit 20 mounted to frame 12, and a pump 22 mounted to a lower portion of frame 12. The control unit 20 projects vertically at least partially above the frame 12 and is operatively coupled with the power unit 16, the pump 22, and hydraulic control system 18. The pumping device 10 may be equipped with a remote control (not shown) that interfaces with the control unit 20 for controlling the operation of pumping device 10.

With continued reference to FIG. 1, the frame 12 has a pair of relatively large rolling support members or wheels 23 at the first longitudinal end 15 and a pair of pivotally mounted rolling support members or wheels 24 at longitudinal end 17 that collectively rollingly support frame 12. Wheels 24 are pivotal about a vertical axis to permit directional guidance or steering of the pumping device 10. The containment hopper 14 is mounted to frame 12 generally above wheels 23 and the power unit 16 is mounted to frame 12 generally above wheels 24.

The power unit 16 is operatively coupled to a hydraulic motor 19 that drives at least one of the wheels 23 with power transferred by a drive assembly 26 known to those of ordinary skill in the art, such as a conventional belt-and-pulley drive or a conventional chain-and-sprocket drive. The power unit 16 provides motive power for self-propelling the pumping device 10. The power unit 16 may be selected from gas, diesel, and propane internal combustion engines and electric motors. Advantageously, at least 18 horsepower to 25 horsepower motors are used, although lower horsepower motors may be used where the motor provides high torque. A suitable unbalanced pressure or force applied to a guide bar 28 provided at longitudinal end 17 causes the pumping device 10 to be steered or directionally guided by pivoting of wheels 24. The guide bar 28 may include a deadman's safety switch interfaced with the hydraulic control system 18 and the control unit 20. Advantageously, pump 10 is, overall, of sufficiently low weight so that it can be moved on its wheels 23 and 24 without motor assistance by pushing or pulling on guide bar 28.

Figure 2:
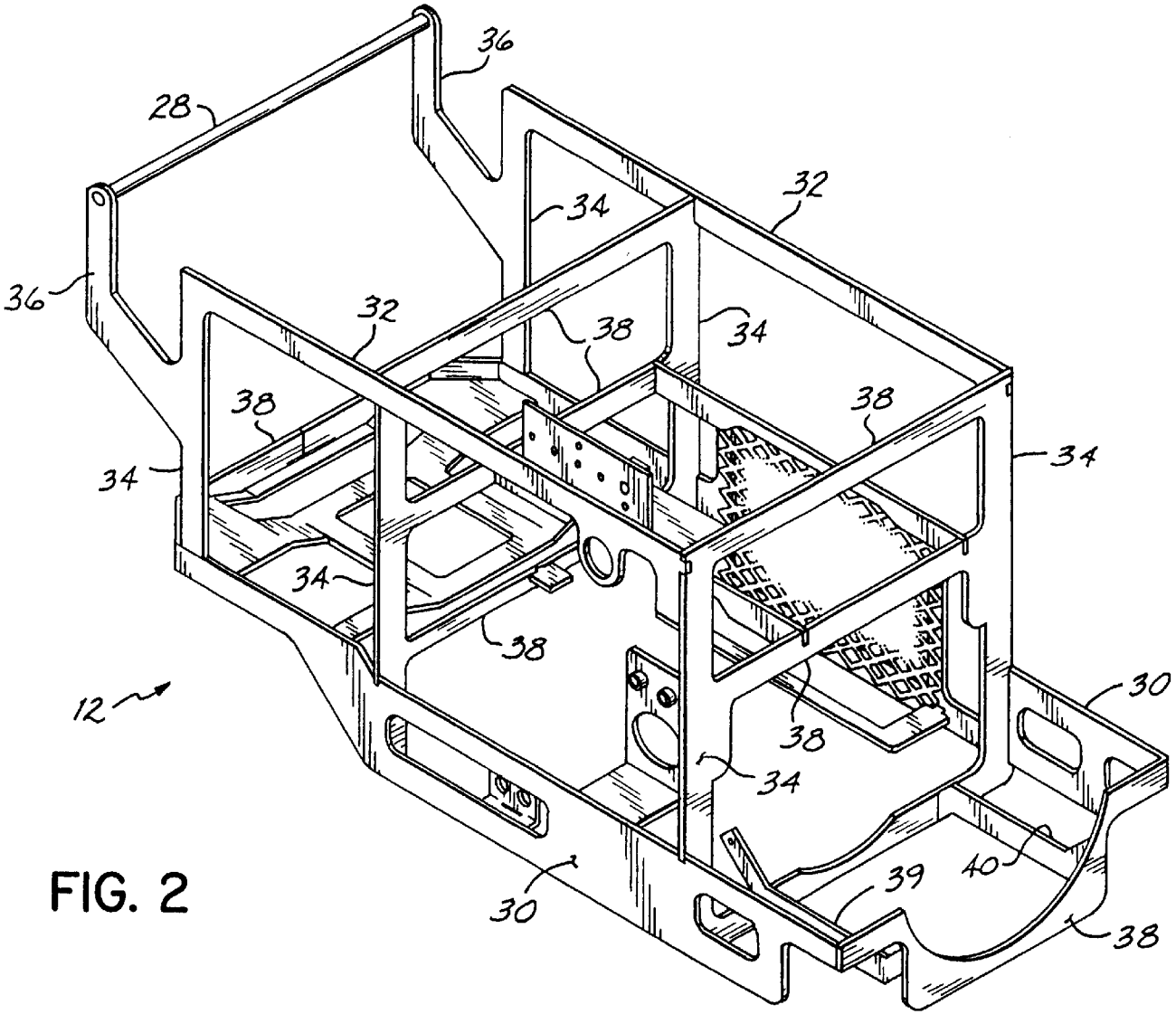
FIG. 2 is a perspective view of the frame of the pumping device of FIG. 1.

With reference to FIG. 2, the frame 12 of the pumping device 10 may advantageously be assembled from components that are laser cut from sheets of material, such as with a numerically controlled laser cutting system. The frame 12 includes a pair of lower, longitudinally-extending side members 30, a pair of upper, longitudinally-extending side members 32, a plurality of, for example, six vertical members 34 interconnecting side members 30 and 32, a pair of transversely-spaced attachment members 36 at longitudinal end 17 for guide bar 28, and a plurality of transversely-extending cross members 38. The members 30, 32, 34, 36 and 38 collectively provide an open support network for supporting the components of the pumping device 10, including containment hopper 14 and pump 22. For example, the containment hopper 14 is supported at longitudinal end 15 by a pair of laterally-spaced support surfaces 39, 40 to which hopper 14 is attached by conventional fasteners and the pump 22 is attached with conventional fasteners to frame 12.

Figure 3:
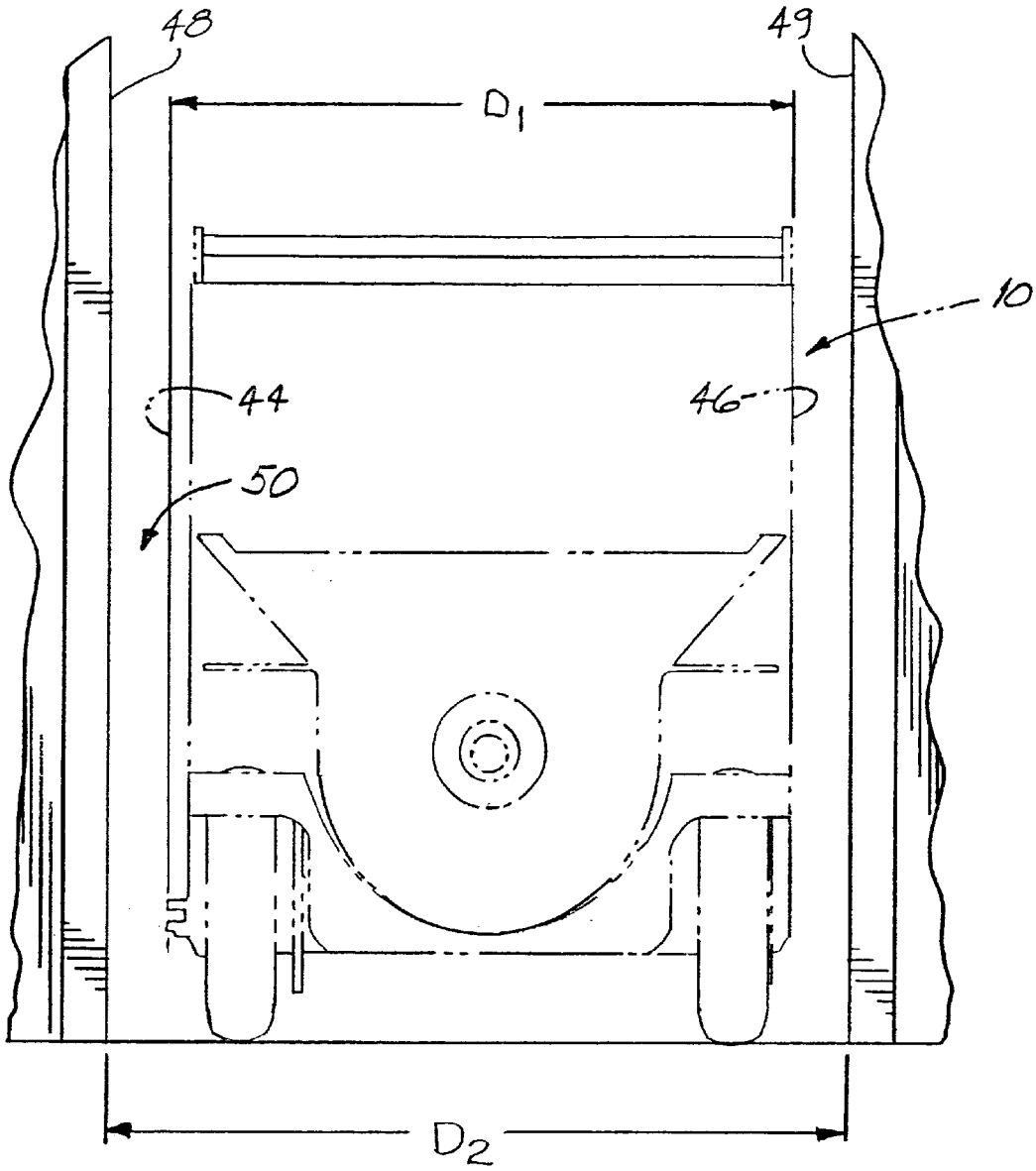
FIG. 3 is an end view of the pumping device of FIG. 1, shown with the pumping device inserted between the side jambs of a standard walkthrough man-door.

With reference to FIG. 3, the pumping device 10 has a length defined by the distance between one longitudinal extremum at longitudinal end 17 and an opposite longitudinal extremum at longitudinal end 15. The extrema, indicated generally by reference numerals 42 and 43 in FIG. 1, are defined as the lengthwise, outermost points of the structure of pumping device 10 and may vary according to the configuration of device 10. The pumping device 10 also has opposite lateral sides 44, 46 that are spaced apart by a width, $D_1$, so dimensioned as to be insertable into the space between confronting side jambs 48, 49 of a standard walk-through man-door 50 having a width $D_2$ (typically about 30 inches). The longitudinal extrema 42, 43 and the lateral sides 44, 46 collectively define a footprint and the frame 12, the containment hopper 14, the pump 22, and the wheels 23, 24 are positioned substantially entirely between the opposite lateral sides 44, 46 of the footprint. The pumping device 10 is self-contained and is readily movable on the wheels 23, 24, such as between the side jambs 48, 49, so that the pumping device 10 can be moved through standard walk-through man-door 50 and positioned readily in enclosed spaces or restricted-access areas that conventional pumping apparatus cannot access. In an exemplary embodiment, the distance or width between the lateral sides 44, 46 is about 29 inches.

With reference to FIG. 1, a mixing apparatus or mixer 52 is provided for use with the pumping device 10 and is removably attachable to the frame 12, as will be described below. The mixer includes a support frame 53, a drum or mixing basin 58 mounted to the support frame 53, and a laterally-spaced pair of pair of rolling support members or wheels 59 attached to a lower portion of the support frame 53. The mixer 52 is adapted to mix an amount of viscous slurry material from, for example, a quantity of dry mix and a volume of water loaded into a drum or mixing basin 58 of the mixer 52. To that end, the mixer 52 includes a mixing element (not shown) positioned in the mixing basin 58 operable for agitating and thoroughly mixing the dry mix and water to form the viscous slurry material. After the viscous slurry material is fully mixed by the mixer 52, the mixing basin 58 is tipped to load the containment hopper 14 with the amount of slurry material. As the viscous slurry material within the containment hopper 14 is depleted by the pumping operation, successive batches of viscous slurry material are prepared using the mixer 52. The successive batches are loaded periodically into the containment hopper 14, thereby maintaining a continuous pumping operation.

The mixer 52 includes a pair of hydraulic lines 54, 55 that are adapted with fittings to couple releasably in fluid communication with complementary fittings carried by the hydraulic control system 18. As a result, the pumping device 10 can provide power to a hydraulic motor 56 powering the mixing element of mixer 52. It is understood that the mixer 52 may be self-powered and, therefor, independent of hydraulic power provided by the pumping device 10.

Figure 4:
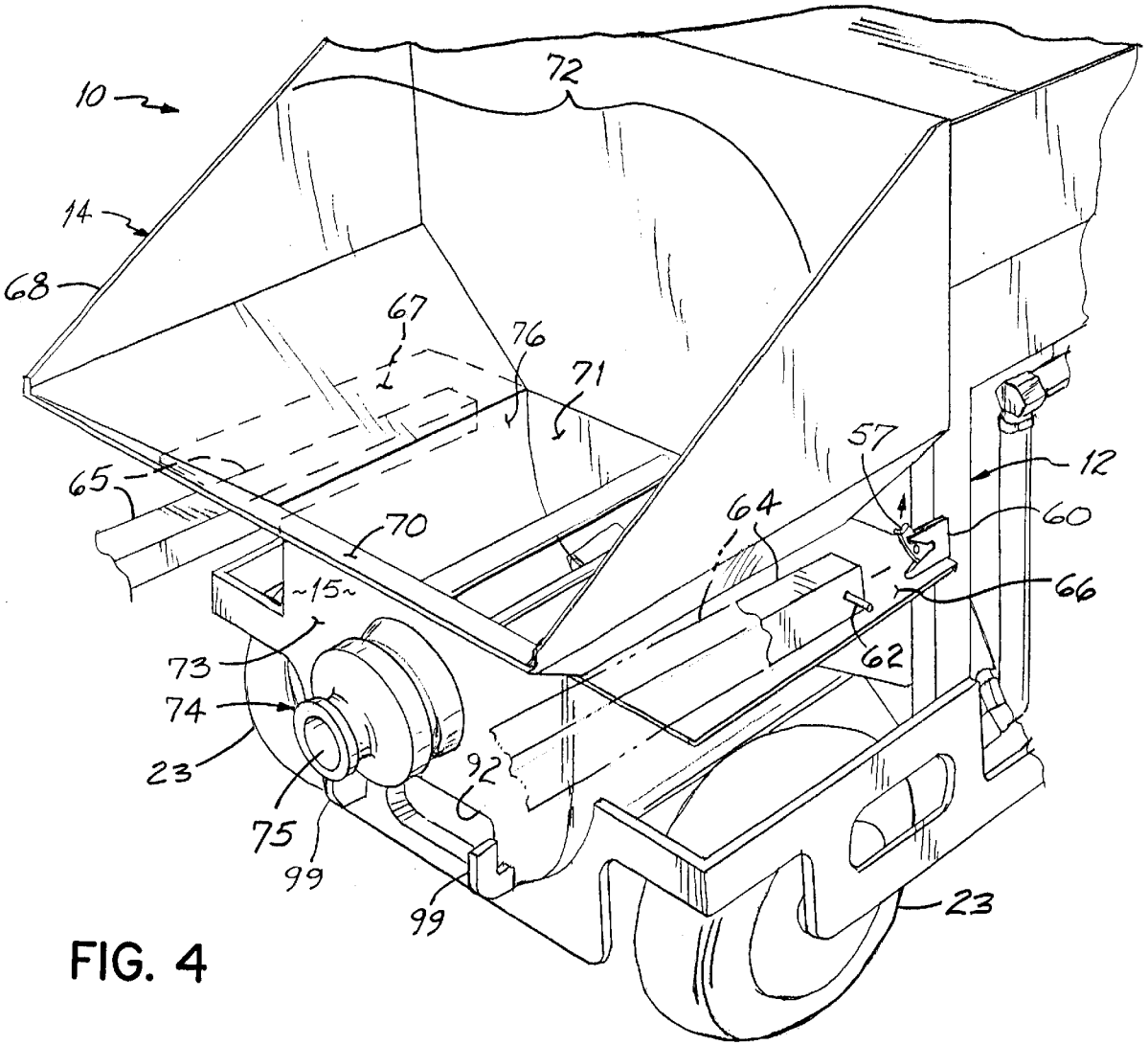
FIG. 4 is a perspective view of one end of the pumping device of FIG. 1.

With reference to FIGS. 1 and 4, the support frame 53 of mixer 52 includes at least one but advantageously a pair of laterally-spaced arms 64, 65 that extend outwardly away in a parallel fashion and pins 62, 63 mounted on respective arms 64, 65. At least one but advantageously a pair of laterally-spaced pivotal latches 60, 61 are mounted on opposite lateral sides of the containment hopper 14. Each of the pivotal latches 60, 61 includes a keeper 57 that is pivotal about a respective horizontal pivot axis generally aligned in the lateral direction. Each keeper 57 is pivotal between a secured position (FIGS. 1 and 4) that captures a respective one of the respective pins 62, 63 in a recess in a respective one of the pivotal latches 60, 61 and an unsecured position (not shown). In the unsecured position, the pins 62, 63 are disengaged from the pivotal latches 60, 61 so that the mixer 52 is not engaged with the frame 12 of the pumping device 10 and the mixer 52 is readily movable on wheels 59. Pivotal latches 60, 61 and pins 62, 63 comprise conventional, complementary engagement elements that are configured to provide a releasable engagement between frame 12 and mixer 52. The complementary engagement elements are at the same level or elevation when mixer 52 is separated from pump 10 so that mixer 52 may be moved laterally into and out of engagement with pump 10 without the need for temporary stilts for, or lifting of, mixer 10. It is apparent that the releasable engagement between frame 12 and mixer 52 may be provided by other types of complementary engagement structures familiar to persons of ordinary skill in the art.

In use, the mixer 52 may be manipulated manually on its wheels 59 so that the pins 62, 63 on arms 64, 65 move into and out of engagement with respective ones of the pivotal latches 60, 61. When the pins 62, 63 are secured by the keepers 57, the frame 12 and the mixer 52 are engaged and are movable as a unit with propulsion provided by the pumping device 10. However, it is appreciated that the mixer 52 is movable separately from the frame 12 when the pins 62, 63 are disengaged from the pivotal latches 60, 61.

With reference to FIG. 4, the frame 12 includes a laterally-spaced pair of support surfaces 66, 67 that may support the arms 64, 65 when are engaged with each other. However, the invention is not so limited and the mechanical support between the frame 12 and mixer 52 may be limited to the physical contact between the pivotal latches 60, 61 and the pins 62, 63. When the mixer 52 is attached to the frame 12, the mixer 52 is positioned relative to the pumping device 10 for providing successive supplies of viscous slurry material 11 (FIG. 5) to the containment hopper 14.

The pumping device 10 is configured to be removably attachable with multiple different types of mixing apparatus.

Figure 1A:
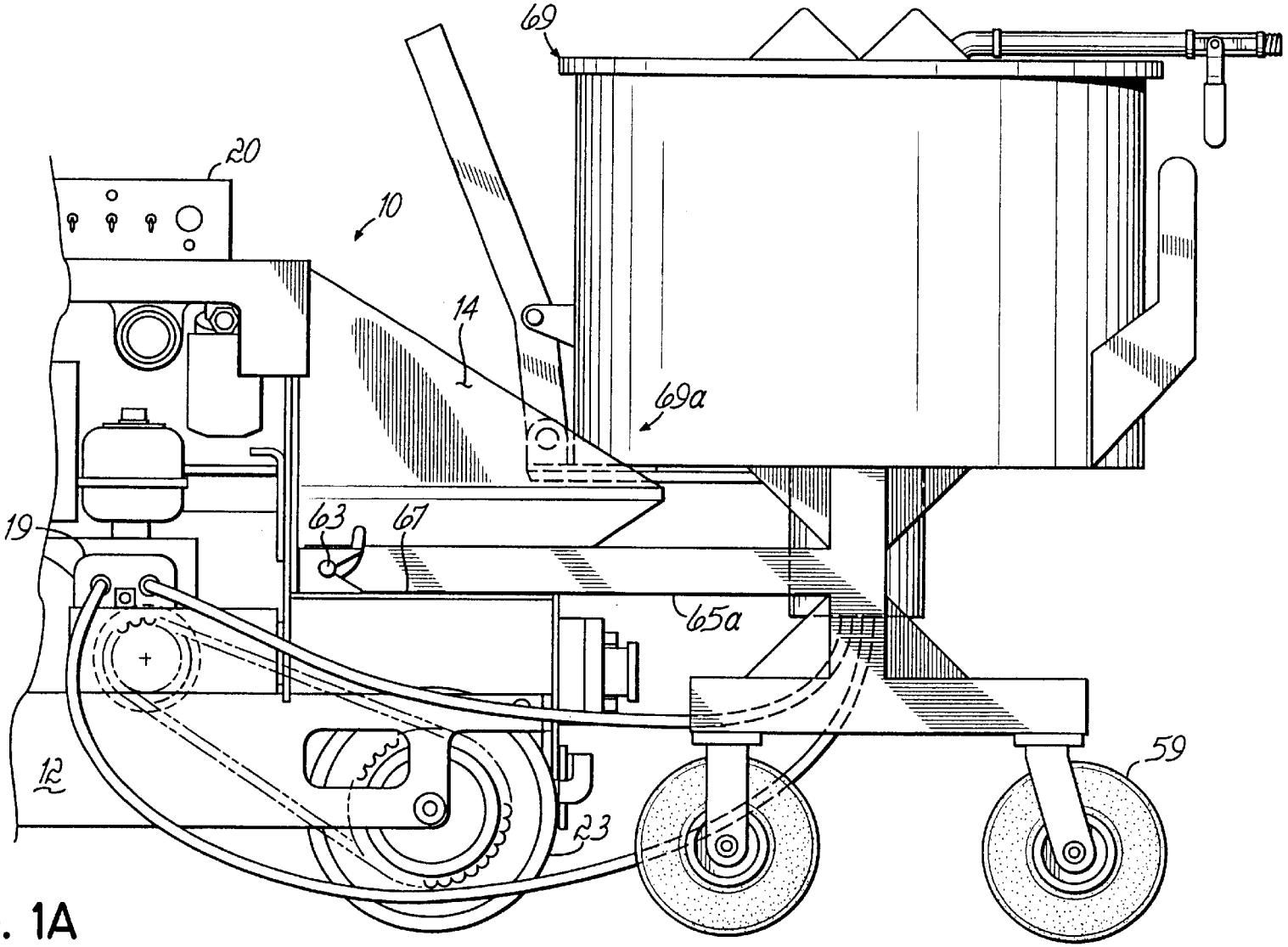
FIG. 1A is a side elevational view of another mixer for use with the pumping device of FIG. 1.

For example and with reference to FIG. 1A, a pan mixer 69 is shown, which is operative for mixing amounts of viscous slurry material 11 (FIG. 5) and providing fully mixed viscous slurry material 11 to the containment hopper 14 of the pumping device 10 via trap door mechanism 69*a*. Mixer 69 is likewise removably attachable to the pumping device 10 with arms 64*a*, 65*a* having respective pins 62*a*, 63*a* that are adapted to releasably engage pivotal latches 60, 61 by moving mixer 69 laterally into and out of position with pump 10. Mixers 52 and 66 may be freely interchanged for use with pumping device 10 without limitation so that the specific type of mixing apparatus can be tailored to the specific type of viscous slurry material 11 being mixed. Additionally, other types of mixers may be used with pumping device 10, such as a continuous mixer (not shown), and which may advantageously be provided with arms and pins (both not shown) to engage with latches 60 and/or 61.

Figure 5:
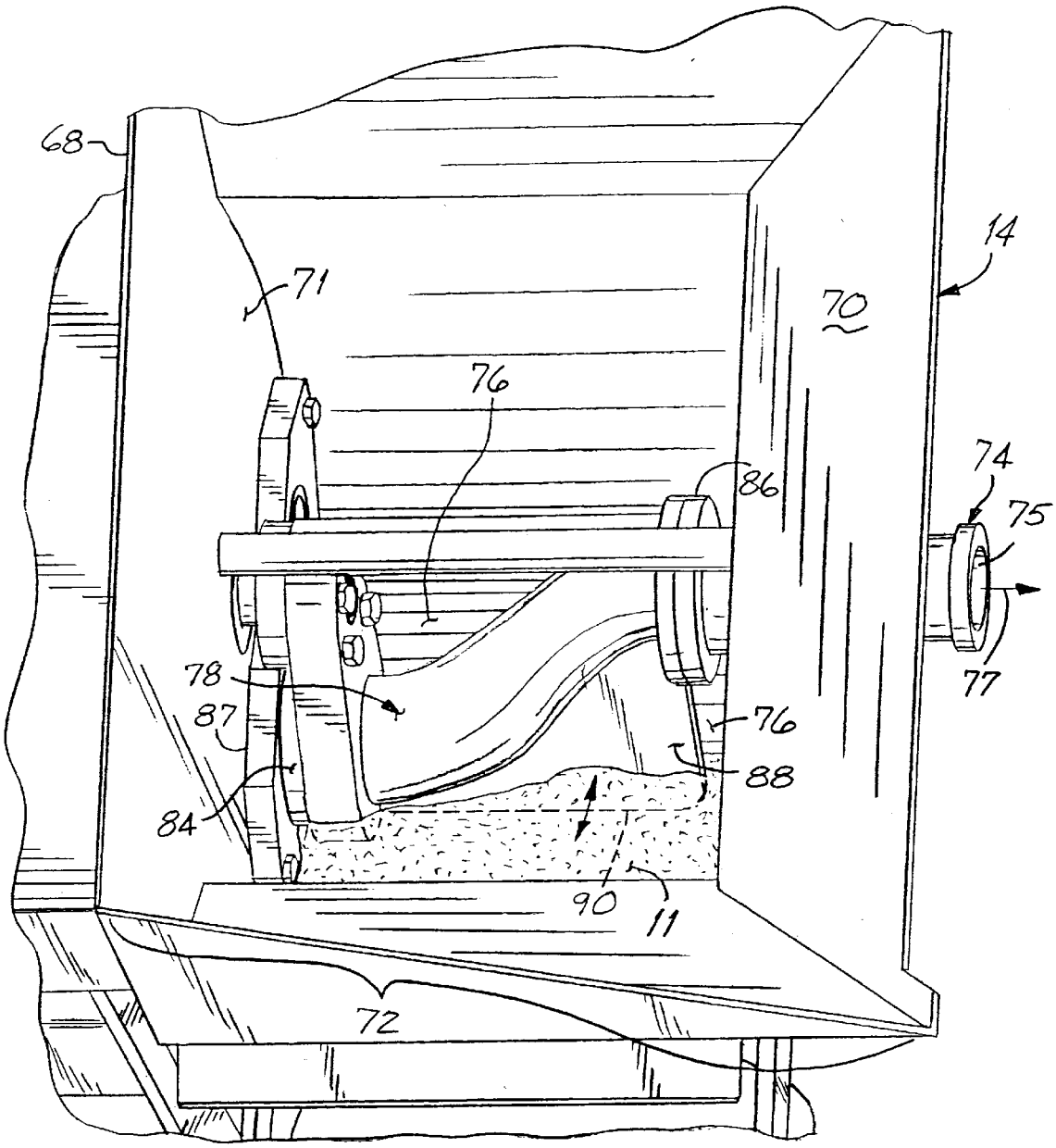
FIG. 5 is a top perspective view of the containment hopper and swing tube pump of the pumping device of FIG. 1.

With reference to FIGS. 1, 4 and 5, the containment hopper 14 includes a downwardly converging, polygonal funnel portion 68, a curved bottom wall 70, opposite side walls 71, 73 that longitudinally enclose the bottom wall 70, an upper opening 72 surrounded by portions of the funnel portion 68 and adapted to receive the viscous slurry material 11, and a discharge outlet fitting 74 extending though side wall 73 at a position below the upper opening 72. The outlet fixture 74 is generally tubular and is adapted with an internal passageway 75 of a circular cross-section. Viscous slurry material 11 is discharged from the containment hopper 14 through the passageway 75 under the action of pump 22. The funnel portion 68 and gravity direct the viscous slurry from the mixer 52 into the containment hopper 14 and guide the viscous slurry material to fill the hopper 14 from the curved bottom wall 70 upwardly toward the upper opening 72. The curved bottom wall 70 defines a concave inner surface 76 which is wetted by the viscous slurry material during use.

Figure 6:
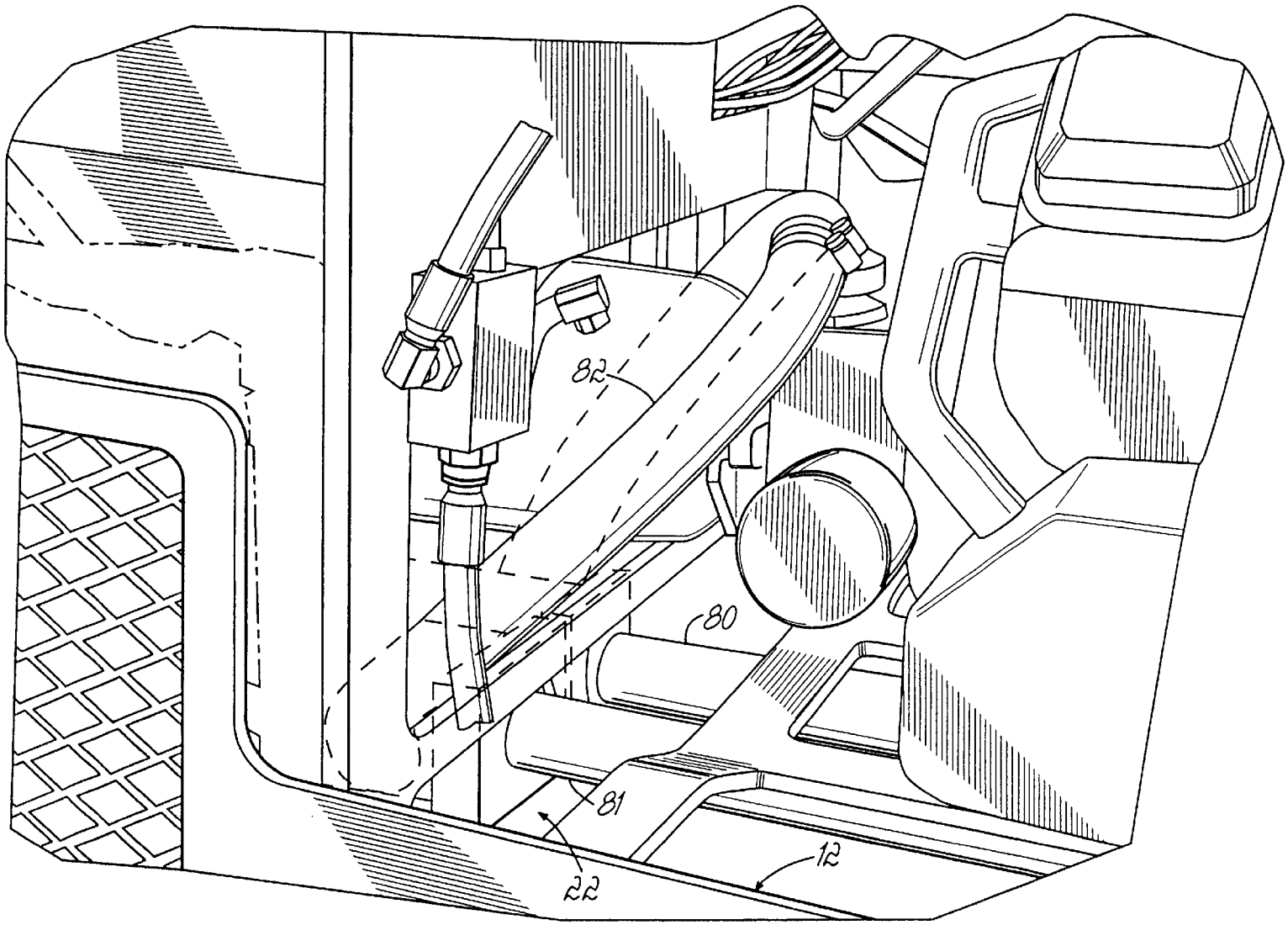
FIG. 6 is side view showing a portion of the pumping device of FIG. 1.

With reference to FIGS. 5 and 6, the pump 22 of the pumping apparatus 10 is illustrated as a swing tube pump adapted to pump the viscous slurry material from the containment hopper 14 to be ejected out of the discharge outlet fitting 74, generally in the direction indicated by arrow 77 (FIG. 5). The discharge outlet fitting 74 is connected to an inlet end of a hose (not shown), through which the viscous slurry material is conveyed to an outlet end of the hose at a desired application site.

The pump 22 includes a swing tube 78 (FIG. 5) horizontally disposed within a lower portion of the containment hopper 14 and a pair of piston pumps 80, 81 (FIG. 6) attached to a bottom portion of frame 12. The piston pumps 80, 81 are operatively associated with the swing tube 78 and are hydraulically coupled with the hydraulic control system 18, which regulates their pumping action and coordinates their pumping action synchronously with the oscillatory movement of the swing tube 78. The pump 22 may be constructed in a manner that eliminates the need for a water box, such as are used in conventional swing tube pumps, by providing one or more flexible fluid hoses 82 (FIGS. 1 and 6) extending from the piston pumps 80, 81. The hoses 82 may be in fluid communication, as shown, or may each terminate separately. The fluid hoses 82 permit ingress and egress of a fluid that provides a cleaning action on the drive rods or rams (not shown) of piston pumps 80, 81. The fluid hoses 82 are readily routed between piston pumps 80, 81 through the open support network furnished by frame 12. A swing tube pump having this construction is disclosed in commonly-assigned and co-pending U.S. patent application Ser. No. 09/898,798 filed on Jul. 5, 2001 and entitled "Slurry Piston Pump," the disclosure of which is hereby incorporated by reference herein in its entirety. With the use of hose(s) 82, the size of pump 10 is not too large as might typically be thought to occur with a standard water box. However, a standard water box may be employed in certain applications.

With continued reference to FIGS. 5 and 6, the hydraulic control system 18 is also hydraulically coupled with a hydraulic shift cylinder 128 (FIG. 8) that periodically moves a relatively-pivotal, segmented shift arm (not shown) for moving or oscillating the swing tube 78 relative to the inner concave surface 76 of the containment hopper 14. The oscillatory motion of the swing tube 78 periodically aligns a circular inlet opening (not shown) in a rearward inlet end 84 of the swing tube 78 with the line of movement of one of the rams (not shown) of the piston pumps 80, 81. The piston pumps 80, 81 are supported by a spectacle flange 87 (FIG. 5) having suitable intake/discharge openings (not shown) that permits the rams to alternatingly to pump successive volumes of viscous slurry material into and out of the front ends of the piston pumps 80, 81. The inlet end 84 of the swing tube 78 receives successive volumes of viscous slurry material under the action of the piston pumps 80, 81. The viscous slurry material is transported through an internal passageway (not shown) of the swing tube 78 to a flanged forward end 86 in fluid communication with the passageway 75 of the outlet fixture 74. The flanged forward end 86 is mounted for rotation to side wall 73 of the containment hopper 14 to accommodate the oscillation of the swing tube 78.

According to an aspect of the invention and with reference to FIG. 5, a wiper blade 88 projects downwardly from an exterior side portion of the swing tube 78 toward the concave inner surface 76 of the containment hopper 14. A bottom edge 90 of the wiper blade 88 has a curvature that closed conforms to the curvature of the concave inner surface 76 so that the two are substantially coextensive. Typically, concave inner surface 76 will have uniform radius of curvature over the range of movement of the wiper blade 88 and the bottom edge 78 will be substantially linear. The wiper blade 88 provides a substantially planar panel that is dimensioned and configured to fill the open space between the underside of the swing tube 78 and the concave inner surface 76. As the swing tube 78 oscillates, the wiper blade 88 operates to agitate the viscous slurry material located between the underside of the swing tube 78 and the concave inner surface 76. Blade 88 is advantageously a flat wall piece, as shown, but could alternatively be a wedge to further move the slurry material toward the piston pumps 80, 81.

Figure 7:
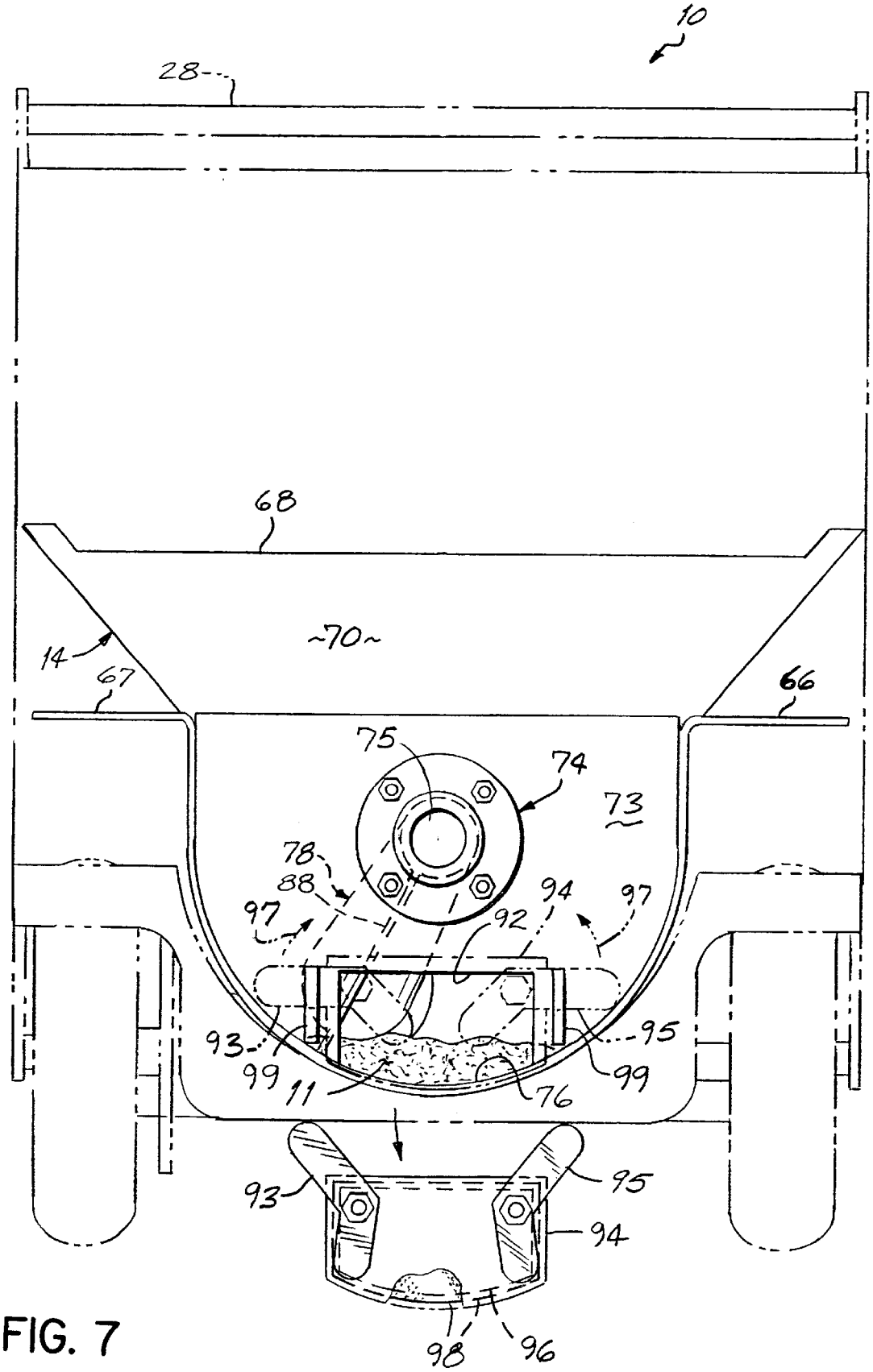
FIG. 7 is a partially-disassembled end view of a portion of the pumping device of FIG. 1, illustrated with the removable panel in the removed position.

With reference to FIG. 7, an aperture 92 is provided in sidewall 73 of the containment hopper 14 and located vertically between the discharge outlet fitting 74 and a portion of concave inner surface 76 so as not to be in the bottom wall 70. Sidewall 73 may also be considered the rear wall of hopper 14. The aperture 92 is normally closed by a removable panel 94. A pair of spaced-apart notched arms 99 are attached to the exterior of side wall 73 adjacent to the periphery of the aperture 92. A pair of swing latches 93, 95 are pivotally attached to an exterior portion of removable panel 94 and are movable, as indicated generally by arrows 97, between a secured condition, shown in dashed lines, and a released condition, shown in full lines. In the secured condition, a side portion of each of the swing latches 93, 95 is captured within one of the notched arms 99. When swing latches 93, 95 are in the released condition, the removable panel 94 is removed from the aperture 92 so that the interior of the containment hopper 14 is accessible for cleaning, such a draining cleaning liquid introduced through upper opening 72.

Another removable panel 96 may be attached to removable panel 94 and is dimensioned and configured to fill at least a portion of aperture 92. A gasket sheet 98 is positioned between the removable panels 94, 96 and overlaps portions of the side wall 73 about the periphery of the aperture 92. The overlapping portion of gasket sheet 98 provides a substantially fluid-tight seal between the panel 94 and the periphery of the aperture 92 when panel 94 is in the secured condition. When the removable panels 94, 96 are installed in aperture 92, the interior surface of the side wall 73 is substantially smooth and continuous due to the presence of removable panel 96 and lacks any areas that would readily trap amounts of viscous slurry material.

Figure 8:
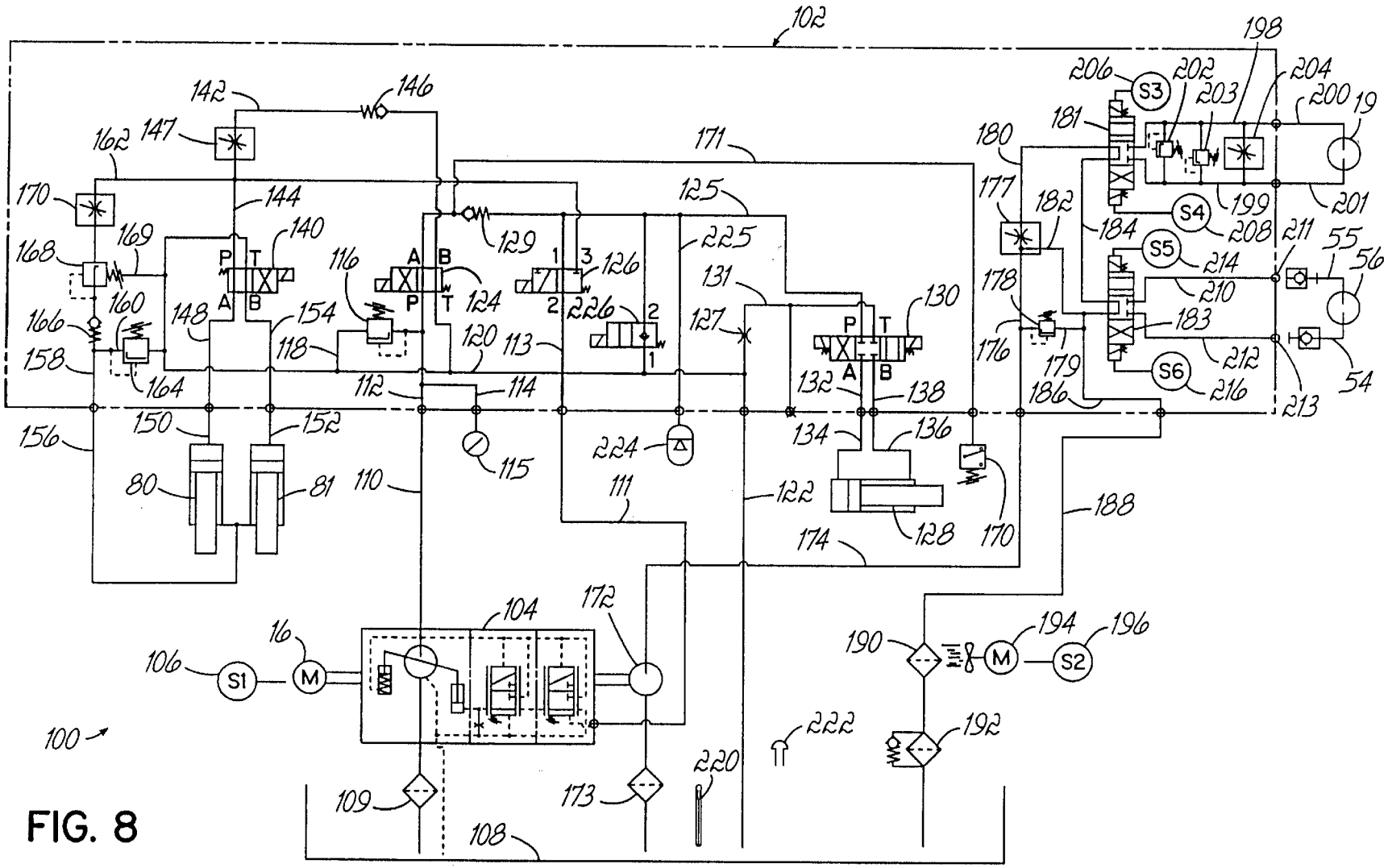
FIG. 8 is a schematic view showing the hydraulic control system of the pumping device of FIG. 1.

The hydraulic control system 18 includes a control manifold 102 formed of a metal block precision drilled with multiple passageways (see FIG. 8). A plurality of flow control devices 103 are within or appending from the metal block, and a plurality of hoses (not shown) couple multiple outlet ports of the passageways of the control manifold 102 into fluid communication with flow control devices 103. For example, the hydraulic control system 18 routes pressurized hydraulic fluid for controlling the cyclical application of the hydraulic pressure to piston pumps 80, 81 and correlating the application of hydraulic pressure to operate piston pumps 80, 81 with the application of hydraulic pressure that provides the oscillating movement of the swing tube 78. The hydraulic pressure is selectively applied so that the inlet end 84 of the swing tube 78 is positioned relative to one or the other of the piston pumps 80, 81 for receiving successive volumes of viscous slurry material 11.

With reference to FIG. 8, a hydraulic circuit, indicated generally by reference numeral 100, for the hydraulic control system 18 (FIG. 1) is diagrammatically illustrated. The hydraulic control system 18 consists of the manifold, indicated generally on FIG. 8 by reference numeral 102, having the form of a generally rectangular block of aluminum, and the hydraulic circuit 100, which includes numerous interconnected internal passageways machined in the manifold 102. The hydraulic circuit 100 controls the operation of the pump 22, the hydraulic motor 19 that drives at least one of the wheels 23 and, optionally, the hydraulic motor 56 powering the mixing element of mixer 52.

The control system 18 includes a variable displacement hydraulic pump 104 energized by power unit 16. Hydraulic pump 104 is a variable displacement pump which has an output that can be changed by varying the speed of power unit 16. Power unit 16 is powered on and off by a switch 106 provided on control unit 20 (FIG. 1). The hydraulic pump 106 withdraws hydraulic fluid from a reservoir 108 through a suction strainer 109 and provides pressurized hydraulic fluid via a supply line 110 to a passageway 112 in manifold 102 and via line 111 to a passageway 113 in manifold 102. A pressure gauge 115 senses the hydraulic pressure in passageway 112 via passageway 114 and provides a visual indication of the hydraulic pressure. A relief valve 116 in passageway 118 monitors the pressure in passageway 112 and diverts the pressurized hydraulic fluid from passageway 112 back to the reservoir 108 over passageway 120 and line 122 if the pressure exceeds a given threshold.

Two solenoid-operated two-way directional-control valves 124, 126 regulate the diversion of pressurized hydraulic fluid to a double-acting hydraulic cylinder 128 that supplies the motive power to oscillate the swing tube 78 and the piston pumps 80, 81 under the control of a conventional pumping electrical circuit (not shown) that synchronizes the oscillation of the swing tube 78 with the operation of the piston pumps 80, 81. Such timing electrical circuits are known to those of ordinary skill in the art and may include, for example, proximity switches on the piston pumps 80, 81 that indicate when the respective piston (not shown) is at the opposite extremes of its stroke. Pressurized hydraulic fluid is provided from directional-control valve 124 through passageway 125 in manifold 102 to a solenoid-operated four-way directional-control valve 130. Pressurized hydraulic fluid is directed through a passageway 131 in manifold 102 to the line 122 in fluid communication with reservoir 108. A check valve 129 is provide in passageway 125 and a pressure reducer 127 is provided in passageway 131.

The hydraulic cylinder 128 has a movable piston (not shown) dividing the interior into a rod end portion and a head end portion, a head end-port end at the head end, and a rod-end port at a rod end, as understood by those of ordinary skill in the art. Pressurized hydraulic fluid is suppled from four-way directional-control valve 130 via passageway 132 in manifold 102 and line 134 to the head-end port and returned to the four-way directional-control valve 130 via passageway 136 in manifold 102 and line 138 from the rod end port to the reservoir 108. This flow directionality extends the piston to position the swing tube 78 to receive viscous slurry material from piston pump 80. The flow paths for the pressurized hydraulic fluid are reversed to retract the piston of hydraulic cylinder 128 so that pressurized hydraulic fluid is supplied to the rod end port via passageway 136 and line 138 and returned from the head end port to the reservoir via passageway 132 and line 134.

With continued reference to FIG. 8 in which the piston of piston pump 80 is extended, pressurized hydraulic fluid is provided to a solenoid-operated two-way directional-control valve 140 from solenoid-operated two-way directional-control valve 124 via passageways 142 and 144 in manifold 102. Passageway 142 includes a check valve 146 and a needle valve 147 that is operative for controlling the speed of piston pumps 80, 81 by regulating the volumetric flow of pressurized hydraulic fluid to pumps 80, 81. The piston pumps 80, 81 have the form of double-acting hydraulic cylinders, each having a movable piston (not shown) dividing the interior into a rod end portion and a head end portion, a head end-port end at the head end, and a rod-end port at a rod end, as understood by those of ordinary skill in the art. As shown in FIG. 8, the solenoid-operated two-way directional-control valve 140 is switched to direct pressurized hydraulic fluid through a passageway 148 in manifold 102 and a line 150 to the head-end port of piston pump 80 and to drain pressurized hydraulic fluid from the head-end port of piston pump 81 via a line 152, a passageway 154 in manifold 102, the passageway 120 and the line 122 to reservoir 108. The rod-end ports of the piston pumps 80, 81 are both connected to a line 156 leading to a passageway 158 in manifold 102. Pressurized hydraulic fluid is withdrawn and supplied, as required, from passageway 158 via passageways 160, 162, respectively, in manifold 102. Passageway 160 includes a relief valve 164 that permits pressurized hydraulic fluid to flow into passageway 120 above a threshold pressure. Passageway 162 includes a check valve 166, a relief valve 168 selectively connected at a threshold pressure with passageway 169 in manifold 102 that is in fluid communication with the passageway 120. Passageway 162 is in fluid communication with the two-way directional-control valve 126. To extend the piston of piston pump 81, two-way directional-control valve 140 reverses the flow paths for the pressurized hydraulic fluid so that pressurized hydraulic fluid is supplied to the head-end port of pump 81 via line 152 and passageway 154 and returned from the head-end port of pump 80 to the reservoir via passageway 148 and line 150. A pressure switch 170 is connected via passageway 171 to passageway 125 and is operative for switching valves 124, 126 to provide the two fluid flow conditions that alternatingly move the piston pumps 80, 81 and the hydraulic cylinder 128 for swing tube 78.

With continued reference to FIG. 8, hydraulic pump 172, powered by hydraulic pump 104, withdraws hydraulic fluid via stainer 173 from the reservoir 108 through a strainer and provides pressurized hydraulic fluid over hydraulic line 174 to a passageway 176 in manifold 102. A relief valve 178 in passageway 176 monitors the pressure passageway 179 and diverts the pressurized hydraulic fluid from passageway 176 back to the reservoir 108 over passageway 186 and line 188 if the pressure exceeds a given threshold. A oil cooler 190 and a filter 192 are coupled in fluid communication with line 188. Oil cooler 190 includes a motorized blower 194 with switched power controlled by switch 196 which is operable to reduce the temperature of the pressurized hydraulic fluid. Filter 192 continuously removes contamination, such as foreign particles, that accumulate in the hydraulic fluid.

Passageway 176 branches into a passageway 180 connected to a solenoid-operated four-way directional-control valve 181, and into a passageway 182 connected to a solenoid-operated four-way directional-control valve 183. A needle valve 177 is provide in passageway 180. One side of each of the four-way directional-control valves 181, 183 is connected in series by a passageway 184. Four-way directional-control valve 181 is operative for selectively and bidirectionally providing pressurized hydraulic fluid through a pair of passageways 198, 199 in manifold 102 to a respective pair of lines 200, 201 that are in fluid communication with the hydraulic motor 19 driving at least one of the wheels 23 (FIG. 1). A pair of cross-port relief valves 202, 203 and a needle valve 204 interconnect the passageways 198, 199. A switch 206 is provided for actuating one solenoid of four-way directional-control valve 181 to direct a flow of pressurized hydraulic fluid into passageway 198 and line 200 operative to rotate the hydraulic motor 19 in a, for example, forward direction. Similarly, a switch 208 is provided for actuating the other solenoid of four-way directional-control valve 181 to direct a flow of pressurized hydraulic fluid into passageway 199 and line 201 operative to rotate the hydraulic motor 19 in a, for example, reverse direction.

With continued reference to FIG. 8, four-way directional-control valve 183 selectively and bidirectionally provides pressurized hydraulic fluid through a pair of passageways 122, 123 in manifold 102 to a pair of auxiliary ports 211, 213 on an outer surface of manifold 102. The auxiliary ports 211, 213 are provided with quick disconnect fittings for the attachment of lines for providing pressurized hydraulic fluid to, for example, mixers, tools, and chemical systems. For example, hydraulic lines 54, 55 of mixer 52 are provided with complementary quick disconnect fittings so that the pressurized hydraulic fluid can be transferred from the auxiliary outlet ports 211, 213 to a hydraulic motor 56 providing rotational kinetic energy to the mixer 52 (FIG. 1). A switch 214 is provided for actuating one solenoid of four-way directional-control valve 183 to direct a flow of pressurized hydraulic fluid into passageway 210 to port 211 and, for example, line 55 operative to rotate the hydraulic motor 56 in a, for example, forward direction. Similarly, a switch 216 is provided for actuating the other solenoid of four-way directional-control valve 183 to direct a flow of pressurized hydraulic fluid into passageway 212 to port 213 and, for example, line 54 operative to rotate the hydraulic motor 56 in a, for example, reverse direction. The circuitry used for controlling the switches 206, 208, 214 and 216 is conventional and familiar to those of ordinary skill in the art.

A sight glass 220 and filter breather 222 are coupled in fluid communication with to a passageway in manifold 102 that is further coupled with the passageway 125. An accumulator 224 is coupled in fluid communication with a passageway 225 in manifold 102 that leads to the passageway 125. A dump valve 226 is provided for exhausting the pressurized hydraulic fluid to the reservoir 108 over passageway 120 and line 122.

In use, the mixer 52 is associated with the frame 12 of pumping device 10 by moving mixer 52 and pump 10 laterally together to engage pivotal latches 60, 61 with pins 62, 63. Switch 106 of control system 18 is actuated to start operation of power unit 16, which in turn energizes hydraulic pumps 104 and 172 to provide pressurized hydraulic fluid to the hydraulic circuit 104. The pumping device 10 and mixer 52 are collectively moved to a location proximate the application site by switching switches 206, 208 as needed to provide forward and rearward propulsion by selectively providing pressurized hydraulic fluid from hydraulic pump 172 to hydraulic motor 19, which drives at least one of wheels 23 via drive assembly 26. The guide bar 28 is used to manually direct the pumping device 10 by pivoting wheels 24. The pumping device 10 may be positioned in enclosed spaces and restricted-access areas, unaccessible to convention pumping devices, for applying or delivering viscous slurry material. For example, the pumping device 10 is dimensioned to be insertable into the space between confronting side jambs 48, 49 of a standard walkthrough man-door 50, as described above. However, the present invention is not so limited and its is understood that pumping device 10 may be positioned at application sites that are readily accessible to conventional pumping devices and used thereafter to apply viscous slurry material.

At the application site, switches 206, 208 as switched as required to terminate propulsion of the pumping device 10 by discontinuing the provision of hydraulic pressure to hydraulic pump 172. After being fixed in position, one end of a distribution hose (not shown) is attached in fluid communication with the discharge outlet fitting 74. The distribution hose may be extended either horizontally or vertically, or in both dimensions and a discharge nozzle is attached to an opposite end of hose. Compressed air may be provided from a compressor (not shown) to suitable outlets adjacent to or within the discharge nozzle for operations that spray the viscous slurry material from application.

The mixer 52 is utilized to mix an amount of viscous slurry material, which is supplied to the upper opening 72 in containment hopper 14. Hydraulic lines 54, 55 of mixer 52 are connected to the ports 211, 212 of hydraulic control system 18 for providing power to agitate and mix the viscous slurry material. Successive batches of viscous slurry material are prepared using the mixer 52 and provided to the pumping device 10 as the viscous slurry material within the containment hopper 14 is depleted during application.

To pump the viscous slurry material from the containment hopper 14 into the hose for subsequent application, the pumping electrical circuit (not shown) is energized to initiate the operation of the piston pumps 80, 81 and the hydraulic cylinder 128 oscillating the swing tube 78. The application of the hydraulic pressure from hydraulic pump 104 to the piston pumps 80, 81 is timed cyclically with the movement of the swing tube 74 by the action of hydraulic cylinder 128, also from hydraulic pressure supplied from hydraulic pump 104. Pressurized hydraulic fluid is selectively applied when the inlet end 84 of the swing tube 78 is periodically and alternatingly positioned relative to one or the other of the piston pumps 80, 81. The hydraulic circuit 100 accomplishes this synchronous performance by the operation of valves 124, 126, 130, and 140, which diverts the pressurized hydraulic fluid as required to piston pumps 80, 81 and hydraulic cylinder 128.

During operation, hydraulic pressure is provided to the head-end port and relieved from the rod-end port of hydraulic cylinder 128 to align the inlet end 84 of swing tube 78 with the line of discharge of viscous slurry material from piston pump 80. Hydraulic pressure is provided to the head-end port of piston pump 80 and relieved from the head-end port of piston pump 81 so that piston pump 80 extends to perform a discharge stroke that discharges a volume of viscous slurry material and piston pump 81 retracts to perform an intake stroke that intakes a volume of viscous slurry material. When the discharge stroke of piston pump 80 has been completed, hydraulic pressure is provided to the rod-end port and relieved from the head-end port of hydraulic cylinder 128 to align the inlet end 84 of swing tube 78 with the line of discharge of viscous slurry material from piston pump 81. The hydraulic pressure to the head-end port of piston pump 80 is relieved and hydraulic pressure is provided to the head end port of piston pump 81. The pressurization and release steps are repeated cyclically to provide a flow of viscous slurry material to the internal passageway 75 of discharge outlet fitting 74.

After application is complete, the pumping device 10 and mixer 52 are collectively or separately removed from the application site by switching switches 206, 208 as needed to provide forward and rearward propulsion by selectively providing pressurized hydraulic fluid from hydraulic pump 172 to hydraulic motor 19, which drives at least one of wheels 23 via drive assembly 26. The guide bar 28 is used to manually direct the pumping device 10 by pivoting wheels 24. The pumping device 10 is cleaned to place it in a state suitable for storage until the next use. In particular, residual viscous slurry material in the containment hopper 14 is removed by providing a flow of a cleansing fluid, such as water, to the upper opening 72 and draining the soiled cleansing fluid from the aperture 92 in side wall 73. The aperture 92 is opened by pivoting swing latches 93, 95 from the secured condition to the released condition and removing removable panels 94, 96 that normally occludes aperture 92.

As can be seen, pumping device 10 is self contained, and need not include any seat or cab portion as is typical of large truck concrete pump systems, and so can be handled and moved about by a single user (not shown) while standing on the ground.

While the present invention has been illustrated by the description of an embodiment thereof and specific examples, and while the embodiment has been described in considerable detail, it is not intended to restrict or in any way limit the scope of the appended claims to such detail. Additional advantages and modifications will readily appear to those skilled in the art. For example, it is contemplated that the pumping device present invention is not limited to having a swing tube pump and may be configured with other types of pumps, such as a ball valve pump. The invention in its broader aspects is therefore not limited to the specific details, representative apparatus and methods and illustrative examples shown and described. Accordingly, departures may be made from such details without departing from the scope or spirit of applicant's general inventive concept.

Having described the invention, what is claimed is:

1. An apparatus for pumping a viscous slurry material, the apparatus defining a footprint between opposite lateral sides and opposite front and back ends, the opposite lateral sides of the footprint spaced apart by a width of the apparatus so dimensioned as to be insertable into the space between the side jambs of a standard walkthrough man-door, the apparatus comprising substantially entirely between at least the opposite lateral sides of the footprint:

a frame;

a hopper supported on the frame, the hopper having an upper opening adapted to receive the viscous slurry material therethrough and an outlet below the upper opening adapted to eject the viscous slurry material;

a swing tube pump adapted to pump the viscous slurry material from the hopper to be ejected out of the hopper outlet, the swing tube pump including a swing tube in the hopper and a piston pump operatively associated with the swing tube; and rolling support members movably supporting the frame;

wherein the apparatus is self-contained and is readily movable on the rolling support members including movement through the space between the side jambs of the standard walkthrough man-door.

2. The apparatus of claim 1 further comprising:

a power unit supported on the frame and operatively coupled to at least the swing tube pump; and a control unit supported on the frame and operatively coupled to the power unit for controlling operation of the swing tube pump.

3. The apparatus of claim 2 wherein the power unit is further operatively coupled to the rolling support members, the power unit provides motive power to at least one of the rolling supporting members so that the apparatus is self-propelled.

4. The apparatus of claim 3 wherein the control unit controls the operation of the rolling support members.

5. The apparatus of claim 1 further comprising a power unit supported on the frame and operatively coupled to at least the swing tube pump, and wherein the frame has a first longitudinal end and a second longitudinal end spaced apart from the first longitudinal end, the hopper located at the first longitudinal end and the power unit located at the second longitudinal end.

6. The apparatus of claim 5 wherein the power unit includes a hydraulic pump and a power source selected from the group consisting of a gasoline engine and an electric motor.

7. The apparatus of claim 1 wherein the frame has a first longitudinal end and a second longitudinal end spaced apart from the first longitudinal end, and the rolling support members include a plurality of laterally-spaced first wheels proximate the first longitudinal end and a plurality of laterally-spaced second wheels mounted proximate the second longitudinal end.

8. The apparatus of claim 7 wherein the first wheels having a larger diametric dimension than the second wheels members.

9. The apparatus of claim 7 wherein the second wheels are pivotally connected to the frame and the second longitudinal end of the frame includes a guide member operable for directing the travel path of the apparatus.

10. The apparatus of claim 1 wherein the frame includes at least one pair of longitudinally extending members and a plurality of cross members extending transversely therebetween, the at least one pair of longitudinally extending members and the plurality of cross members providing an open support network for at least the hopper and the swing tube pump.

11. The apparatus of claim 1 further comprising a mixer operable for mixing the supply of viscous slurry material and thereafter providing the supply of viscous slurry material to the hopper, the mixer releasably attachable to the frame and so dimensioned as to be insertable into the space between the side jambs of the standard building doorway.

12. The apparatus of claim 11 further comprising a power unit supported on the frame and operatively coupled to at least the swing tube pump, the power unit capable of being further operatively coupled to the mixer for providing hydraulic power thereto for mixing the supply of the viscous slurry material.

13. The apparatus of claim 1 wherein the frame has a height so dimensioned as to be insertable into the space between an overhead jamb of the standard walkthrough man-door and a surface spaced vertically from the overhead jamb and with which the rolling support members are engaged.

14. An apparatus for pumping a viscous slurry material, comprising:

a frame having at least a first engagement element;

a hopper supported by the frame adjacent the first engagement element at a first elevation, the hopper having an upper opening adapted to receive the viscous slurry material therethrough and an outlet below the upper opening adapted to eject the viscous slurry material;

a pump adapted to pump the viscous slurry material from the hopper to be ejected out of the outlet; and a first mixer being movably supported on a rotatable member and being adapted to be removably attached to the frame, the first mixer including at least a second engagement element at the same elevation as the first engagement element and adapted to engage the first engagement element of the frame when the first mixer and frame are laterally moved together, whereby when attached, the first mixer is positioned to provide a supply of the viscous slurry material to the hopper through the upper opening thereof, the first mixer and frame being attachable together without requiring that the mixer be held up on stilts or lifted.

15. The apparatus of claim 14 wherein the first mixer includes a pair of spaced-apart arms and the frame includes a spaced-apart pair of support surfaces capable of support the arms when the first and second engagement elements are engaged.

16. The apparatus of claim 14 further comprising:

a power unit supported on the frame and operatively coupled to at least the pump; and a control unit supported on the frame and operatively coupled to the power unit and at least the pump, the power unit and control unit being further selectively operatively coupled to the first mixer when the first mixer is attached to the frame.

17. The apparatus of claim 16 wherein the power unit further supplies hydraulic power to the first mixer.

18. The apparatus of claim 14 further comprising:

first wheels movably supporting the frame such that the frame and the first mixer are movable as a unit when the first and second engagement elements are engaged, and the first mixer may be moved separately from the frame when the first and second engagement elements are disengaged.

19. The apparatus of claim 14 wherein the first engagement member is a pivotal latch and the second engagement member is a pin adapted to actuate the pivotal latch for securing the first mixer to the frame by engagement of the pin and the pivotal latch.

20. The apparatus of claim 14 further comprising a second mixer being movably supported on a rotatable member and being adapted to be removably attached to the frame, the second mixer including at least a third engagement element at the same elevation as the first engagement element and adapted to engage the first engagement element of the frame when the second mixer and frame arc laterally moved together, whereby when attached, the second mixer is positioned to provide a supply of the viscous slurry material to the hopper through the upper opening thereof, the first and the second mixers being selectively and separately removably attachable to the frame.

21. An apparatus for pumping a viscous slurry material, comprising:

a frame;

a hopper mounted to the frame, the hopper having an upper opening adapted to receive the viscous slurry material therethrough, an outlet below the upper opening adapted to eject the viscous slurry material, and a bottom wall below the opening and outlet defining a concave surface in the hopper; and a swing tube pump adapted to pump the viscous slurry material from the hopper to be ejected out of the hopper outlet, the swing tube pump mounted to the frame and including a swing tube in the hopper adapted to move relative to the concave surface in the hopper and a piston pump operatively associated with the swing tube, the swing tube further including a wiper blade affixed thereto and conforming to the curvature of the concave surface in the hopper, whereby to agitate the viscous slurry material located between the swing tube and concave surface.

22. The apparatus of claim 21 wherein the hopper includes a side wall extending between the bottom wall and the upper opening, the side wall having an aperture therethrough communicating into the hopper, and a first removable panel covering the side wall aperture and normally closing the side wall aperture, the aperture located between the outlet and concave surface and the first removable panel being removable from the aperture to access the hopper for cleaning thereof.

23. The apparatus of claim 22 wherein the hopper includes a second removable panel dimensioned and configured to fill at least a portion of the side wall aperture and a gasket sheet positioned between the first and the second removable panels.

24. The apparatus of claim 23 wherein the first removable panel fills the side wall aperture so that interior of the side wall of the hopper is substantially smooth and continuous.

25. The apparatus of claim 21 wherein at least a portion of the swing tube is spared from the concave surface to provide an opening and the wiper blade substantially fills the opening.

26. An apparatus for pumping a viscous slurry material, comprising:

a frame;

a hopper having an upper opening adapted to receive the viscous slurry material therethrough and an outlet below the upper opening adapted to eject the viscous slurry material, the hopper further having a side wall with an aperture therethrough communicating into the hopper;

a swing tube pump adapted to pump the viscous slurry material from the hopper to be ejected out of the hopper outlet, the swing tube pump including a swing tube in the hopper and a piston pump operatively coupled with the swing tube; and a first removable panel associated with the hopper side wall and normally closing the side wall aperture, the first removable panel being removable from the aperture to access the hopper for cleaning thereof.

27. The apparatus of claim 26 wherein the hopper includes a bottom surface below the swing tube, the side wall aperture being situated between the bottom surface and the swing tube.

28. The apparatus of claim 26 wherein the hopper includes a second removable panel dimensioned and configured to fill at least a portion of the side wall aperture and a gasket sheet positioned between the first and the second removable panels.

29. An apparatus for pumping a viscous slurry material, comprising:

a frame;

a hopper supported on the frame, the hopper having an upper opening adapted to receive the viscous slurry material therethrough and an outlet below the upper opening adapted to eject the viscous slurry material;

a swing tube pump adapted to pump the viscous slurry material from the hopper to be ejected out of the hopper outlet;

rolling support members movably supporting the frame with the frame being sized to be manipulated and moved on the roller support members by a user standing on the ground; and a power unit supported on the frame and operatively coupled to the system tube pump and the rolling support members, the power unit adapted to selectively provide motive power to at least one of the rolling supporting members so that the apparatus is self-propelled.

30. The apparatus of claim 29 wherein the frame has a first longitudinal end and a second longitudinal end spaced apart from the first longitudinal end, and the rolling support members include a plurality of laterally-spaced first wheels proximate the first longitudinal end and a plurality of laterally-spaced second wheels mounted proximate the second longitudinal end.

31. The apparatus of claim 30 wherein the first wheels having a larger diametric dimension than the second wheels members.

32. The apparatus of claim 30 wherein the second wheels are pivotally connected to the frame and the second longitudinal end of the frame includes a guide member operable for directing the travel path of the apparatus.

33. The apparatus of claim 29 further comprising a mixer adapted to be removably attached to the frame, so that when the first mixer is attached to the frame, the mixer is positioned to provide a supply of the viscous slurry material to the hopper through the upper opening thereof.

34. The apparatus of claim 29 wherein the frame and the mixer are movable as a unit when the mixer is attached to the frame.

35. The apparatus of claim 33 wherein the power unit is operatively coupled with the mixer for providing power thereto for mixing the supply of the viscous slurry material.

36. An apparatus for pumping a viscous slurry material, comprising:

a frame assembled from sections formed by laser cutting;

a hopper supported by the frame, the hopper having an upper opening adapted to receive the viscous slurry material therethrough and an outlet below the upper opening adapted to eject the viscous slurry material; and a pump adapted to pump the viscous slurry material from the hopper to be ejected out of the outlet.

37. The apparatus of claim 36 wherein the frame includes at least one pair of longitudinally extending members and a plurality of cross members extending transversely therebetween, the at least one pair of longitudinally extending members and the plurality of cross members providing an open support network for at least the hopper and the pump.

38. An apparatus for pumping a viscous slurry material, comprising:

a frame;

a hopper supported on the frame, the hopper having an upper opening adapted to receive the viscous slurry material therethrough and an outlet below the upper opening adapted to eject the viscous slurry material;

a pump adapted to pump the viscous slurry material from the hopper to be ejected out of the hopper outlet;

a power unit supported on the frame and operatively coupled to the swing tube pump, the power unit including a hydraulic pump capable of pumping hydraulic fluid and a power supply operatively coupled with the hydraulic pump; and a control unit supported on the frame and operatively coupled to the power unit and at least the pump, the control unit including a block manifold with numerous internal passageways and various valves controlling the flow of hydraulic fluid to the pump, wherein the manifold being a single block of material having drill formed internal passageways.

* * * * *

UNITED STATES PATENT AND TRADEMARK OFFICE

CERTIFICATE OF CORRECTION

PATENT NO. : 6,733,247 B2
DATED : May 11, 2004
INVENTOR(S) : Bernard B. Dwyer and Kenneth T. Eddy It is certified that error appears in the above-identified patent and that said Letters Patent is hereby corrected as shown below:

Column 1,
Line 38, “pump is an swing tube” should read -- pump is a swing tube --
Line 45, “tube pumps suffers from” should read -- tube pumps suffer from --

Column 3,
Line 63, “specification, illustrates an” should read -- specification, illustrate an --

Column 4,
Line 15, “FIG. 6 is side view” should read -- FIG. 6 is a side view --

Column 5,
Line 61, “pair of pair of rolling support members” should read -- pair of rolling support members --

Column 6,
Line 16, “and, therefor, independent” should read -- and, therefore, independent --
Line 58, “when are engaged with” should read -- when they are engaged with --

Column 8,
Line 18, “to alternatingly to pump” should read -- to alternatingly pump --
Line 33, “closed conforms to” should read -- closely conforms to --
Line 66, “such a draining liquid” should read -- such as draining liquid --

Column 10,
Line 10, “is provide in passageway” should read -- is provided in passageway --

Column 11,
Line 9, “via stainer 173” should read -- via strainer 173 --
Line 26, “valve 177 is provide in passageway” should read -- valve 177 is provided in passageway --

Column 12,
Line 5, “fluid communication with to a” should read -- fluid communication with --
Line 33, “and its is understood” should read -- and it is understood --
Line 37, “switches 206, 208 as switched” should read -- switches 206, 208 are switched --

UNITED STATES PATENT AND TRADEMARK OFFICE

CERTIFICATE OF CORRECTION

PATENT NO. : 6,733,247 B2
DATED : May 11, 2004
INVENTOR(S) : Bernard B. Dwyer and Kenneth T. Eddy It is certified that error appears in the above-identified patent and that said Letters Patent is hereby corrected as shown below:

Column 13,
Line 26, "to the head end port" should read -- to the head-end port --
Line 46, "that normally occludes aperture 92" should read -- that normally occlude aperture 92 --
Line 66, "applicant's general inventive" should read -- applicants' general inventive --

Column 14,
Lines 57-58, "second wheels members." should read -- second wheels. --

Column 15,
Line 45, "capable of support" should read -- capable of supporting --

Column 16,
Line 54, "tube is spared from" should read -- tube is spaced from --

Column 17,
Lines 45-46, "second wheel members." should read -- second wheels. --

Signed and Sealed this

Seventeenth Day of August, 2004

JON W. DUDAS
*Acting Director of the United States Patent and Trademark Office*